US009287660B2

(12) United States Patent
Henry et al.

(10) Patent No.: US 9,287,660 B2
(45) Date of Patent: Mar. 15, 2016

(54) PLUGGABLE CONNECTOR HAVING A COUPLING MECHANISM

(71) Applicant: Tyco Electronics Corporation, Berwyn, PA (US)

(72) Inventors: Randall Robert Henry, Harrisburg, PA (US); Michael John Phillips, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 43 days.

(21) Appl. No.: 14/193,185

(22) Filed: Feb. 28, 2014

(65) Prior Publication Data

US 2015/0249304 A1 Sep. 3, 2015

(51) Int. Cl.
*H01R 13/627* (2006.01)
*H01R 24/60* (2011.01)

(52) U.S. Cl.
CPC ..... *H01R 13/6275* (2013.01); *H01R 24/60* (2013.01)

(58) Field of Classification Search
CPC .... H01R 13/64; H01R 24/68; H01R 13/6271; H01R 13/6272; H01R 13/6275; H01R 13/6273; H01R 13/6335; H01R 13/635; H01R 43/26
USPC ..... 439/352, 358
See application file for complete search history.

(56) References Cited

U.S. PATENT DOCUMENTS

| | | | | |
|---|---|---|---|---|
| 7,476,117 | B1 * | 1/2009 | Chen et al. | 439/352 |
| 7,534,125 | B1 * | 5/2009 | Schroll | 439/352 |
| 7,753,710 | B2 * | 7/2010 | George | 439/352 |
| 8,231,400 | B2 * | 7/2012 | Phillips et al. | 439/357 |

* cited by examiner

*Primary Examiner* — Xuong Chung Trans

(57) ABSTRACT

Pluggable connector including a connector housing having a mating end that is configured to engage a communication component during a mating operation. The pluggable connector also includes a coupling mechanism that is attached to the connector housing. The coupling mechanism includes a component latch and a biasing finger that engages the component latch. The component latch is rotatable about a pivot axis between open and closed positions and has an operative end that moves relative to the connector housing when the component latch is rotated about the pivot axis. The biasing finger engages the component latch at a contact area that is generally between the pivot axis and the operative end when the component latch rotates from the closed position toward the open position. The biasing finger provides a biasing force at the contact area for rotating the component latch toward the closed position.

20 Claims, 5 Drawing Sheets

PLUGGABLE CONNECTOR HAVING A COUPLING MECHANISM

BACKGROUND

The subject matter herein relates generally to a pluggable connector having a coupling mechanism for securing the pluggable connector to a mating component.

Pluggable cable assemblies may be used to transfer data to and from different communication systems or devices. Known cable assemblies include serial attached (SA) small computer system interface (SCSI) cable assemblies, which may also be referred to as SAS cable assemblies. Such cable assemblies may include a pluggable connector having a mating end and a loading end. The mating end is inserted into a receptacle assembly of the communication system, and the loading end receives a cable of the cable assembly. In some cases, the pluggable connector includes a circuit board that has electrical contacts, such as contact pads, that are exposed at the mating end. The circuit board may be mechanically and electrically coupled to wire conductors of the cable. During a mating operation, the mating end is inserted into a cavity of the receptacle assembly. The electrical contacts at the mating end engage corresponding electrical contacts of a mating connector within the cavity.

When the pluggable connector is engaged with the receptacle assembly, the pluggable connector may experience forces that pull or push the pluggable connector away from the receptacle assembly. For example, deflection forces between the pluggable connector and the mating connector may push the pluggable connector away from the receptacle assembly. Likewise, the cable may be inadvertently pulled. In either case, the pluggable connector and the receptacle assembly may become disengaged thereby disrupting data transmission.

To maintain the communicative engagement, the pluggable connector may include a coupling mechanism having one or more latches that rotate between open and closed positions about an axle. During the mating operation, each latch may be deflected away from the closed position when the corresponding latch engages an edge of the receptacle assembly. At least one known pluggable connector includes a coil spring that returns the latch to the closed position so that the latch may grip a portion the receptacle assembly. Accordingly, the latch may prevent the pluggable connector from being inadvertently withdrawn from the receptacle assembly when in the closed position.

While such coupling mechanisms can be effective, the coil spring and associated axles may occupy space within the pluggable connector that could be used for other purposes. Such coupling mechanisms may also include multiple small parts, such as the coil spring, that can be challenging to assemble. Pluggable connectors such as those described above may also include internal fasteners that secure different parts of the pluggable connector to one another. Again, such fasteners may occupy space that could be used for other purposes and may further complicate the assembly process.

Accordingly, there is a need for a pluggable connector having a coupling mechanism that occupies less space within the pluggable connector and may have a simpler construction than other known coupling mechanisms.

BRIEF DESCRIPTION

In an embodiment, a pluggable connector is provided that includes a connector housing having a mating end that is configured to engage a communication component during a mating operation. The pluggable connector also includes a coupling mechanism that is attached to the connector housing. The coupling mechanism includes a component latch and a biasing finger that engages the component latch. The component latch is rotatable about a pivot axis between open and closed positions and has an operative end that moves relative to the connector housing when the component latch is rotated about the pivot axis. The biasing finger engages the component latch at a contact area that is generally between the pivot axis and the operative end when the component latch rotates from the closed position toward the open position. The biasing finger provides a biasing force at the contact area for rotating the component latch toward the closed position.

In certain embodiments, the component latch may have an inner edge that faces the connector housing and an outer edge that faces away from the connector housing. The contact area may be along the outer edge, and the biasing force may be toward the connector housing. In certain embodiments, the pluggable connector may include a connector retainer, and the connector housing may have first and second housing shells. The connector retainer may engage the first and second housing shells to secure the first and second housing shells to each other. The connector retainer may include the biasing finger.

In an embodiment, a pluggable connector is provided that includes a connector housing having a mating end that is configured to engage a communication component during a mating operation. The connector housing has first and second housing shells. The pluggable connector also includes a connector retainer having a retainer clip that secures the first and second housing shells to each other. The connector retainer includes a retainer extension that extends from the retainer clip toward the mating end. The retainer extension includes a biasing finger. The pluggable connector also includes a component latch that is coupled to the connector housing and has an operative end configured to engage the communication component. The component latch rotates from a closed position to an open position during the mating operation. The biasing finger engages the component latch when the component latch is in the open position to provide a biasing force for rotating the component latch toward the closed position.

DETAILED DESCRIPTION

Figure 1:
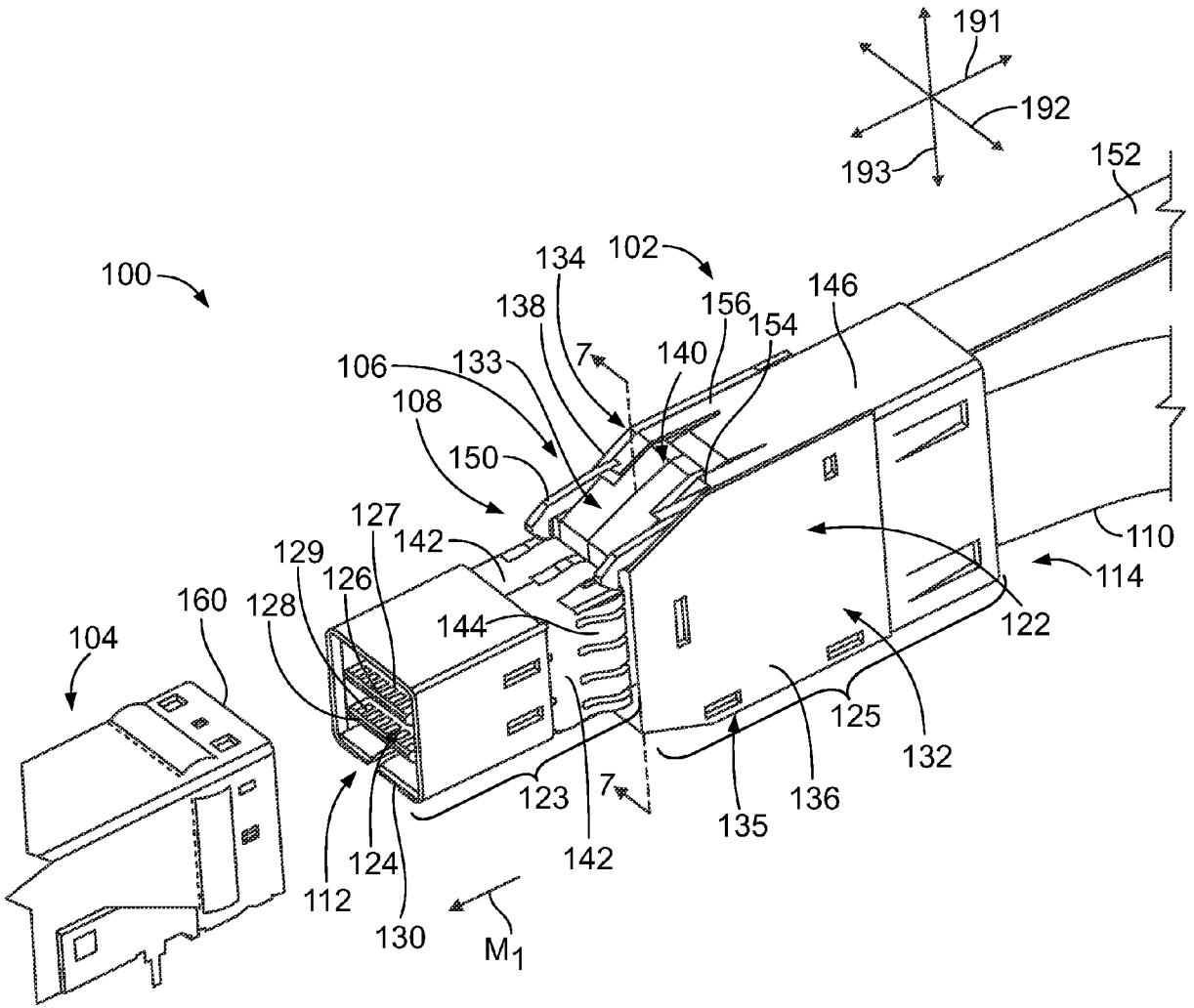
FIG. 1 is a perspective view of a communication system formed in accordance with an embodiment.

FIG. 1 is a perspective view of a communication system 100 formed in accordance with an embodiment that includes a cable assembly 102 and a communication component or device 104 that are configured to engage each other. The cable assembly 102 includes a pluggable connector 106, a coupling mechanism 108 that is coupled to the pluggable connector 106, and a communication cable 110. The pluggable connector 106 has a connector housing 122 that includes a mating end 112 and a trailing end 114. The mating and trailing ends 112, 114 may face in opposite directions. The communication cable 110 is coupled to and/or inserted through the trailing end 114 of the connector housing 122. Although not shown, the cable assembly 102 may include another pluggable connector 106 at an opposite end of the communication cable 110. For reference, the communication system 100 is oriented with respect to mutually perpendicular axes 191-193, including a mating axis 191, a lateral axis 192, and an elevation axis 193. In the illustrated embodiment, the communication component 104 is a receptacle assembly having a cavity (not shown) for receiving a portion of the pluggable connector 106. The communication component 104 is hereinafter referred to as the receptacle assembly 104, but it is understood that the pluggable connector 106 may engage or mate with other communication components.

The mating end 112 of the connector housing 122 is configured to be inserted into the cavity of the receptacle assembly 104. To insert the mating end 112 into the receptacle assembly 104, the pluggable connector 106 is aligned with respect to the cavity of the receptacle assembly 104 and advanced toward the receptacle assembly 104 in a mating direction $M_1$. The mating end 112 is inserted into the receptacle assembly 104 and advanced toward a mating connector (not shown) disposed within the cavity. The pluggable connector 106 and the receptacle assembly 104 may form a pluggable engagement. As described herein, the coupling mechanism 108 may removably couple the pluggable connector 106 to the receptacle assembly 104 and prevent the pluggable connector 106 and the receptacle assembly 104 from being inadvertently disengaged such that data transmission is interrupted.

As shown, the communication cable 110 is coupled to the pluggable connector 106 at the trailing end 114. Although not shown, in an exemplary embodiment, the communication cable 110 includes insulated wires having jackets that surround wire conductors. The wire conductors are configured to transfer data signals and/or electrical power. In other embodiments, the communication cable 110 may have optical fibers that are configured to transmit data signals in the form of optical signals. The pluggable connector 106 may be characterized as an input/output (I/O) module that is capable of being repeatedly inserted into and removed from the cavity of the receptacle assembly 104.

The communication system 100, the cable assembly 102, and/or the pluggable connector 106 may be configured for various applications. Non-limiting examples of such applications include host bus adapters (HBAs), redundant arrays of inexpensive disks (RAIDs), workstations, rack-mount servers, servers, storage racks, high performance computers, or switches. The communication system 100 may be, or may be part of, an external serially attached (SA) small computer system interface (SCSI). In such embodiments, the cable assembly 102 may be referred to as a serially attached SCSI (SAS) cable assembly. The cable assembly 102 may be configured for one or more industry standards, such as SAS 2.1 in which the cable assembly 102 may be capable of transmitting six (6) gigabits per second (Gbps) for each lane. In more particular embodiments, the cable assembly 102 may be configured for SAS 3.0 and/or at 12 Gbps or more per lane. The pluggable connector 106 may be configured to be compliant with small form factor (SFF) industry standards, such as SFF-8644 or SFF-8449 HD. In some embodiments, the cable assembly 102 may be similar to the cable assembly used with the Mini SAS HD Interconnect, which is available from TE Connectivity.

The connector housing 122 forms a housing cavity 124 that opens to the mating end 112. The connector housing 122 has a plug portion 123 that is sized and shaped to be inserted into the cavity of the receptacle assembly 104, and a body portion 125 that is not inserted into the cavity of the receptacle assembly 104. The plug portion 123 includes a front edge 130 of the connector housing 122 at the mating end 112. The body portion 125 may be configured to be gripped by an individual.

In the illustrated embodiment, the pluggable connector 106 includes two circuit boards 126, 128 having electrical contacts 127, 129, respectively. The circuit boards 126, 128 are disposed within the housing cavity 124. The electrical contacts 127, 129 are configured to engage corresponding electrical contacts (not shown) of the communication connector in the receptacle assembly 104. In some embodiments, the electrical contacts 127, 129 are contact pads of the circuit boards 126, 128, respectively. In alternative embodiments, however, the electrical contacts 127, 129 may be other types of electrical contacts, such as contact beams.

The body portion 125 of the connector housing 122 includes sidewalls 132, 133, 134, 135. The sidewalls 132, 134 face in opposite directions along the lateral axis 192 and extend longitudinally along the mating axis 191 between the plug portion 123 and the trailing end 114. The sidewalls 133, 135 face in opposite directions along the elevation axis 193 and extend longitudinally along the mating axis 191 between the plug portion 123 and the trailing end 114. The sidewalls 133, 135 extend laterally between the sidewalls 132, 134. In the illustrated embodiment, the sidewall 133 is configured to engage the coupling mechanism 108. In alternative embodiments, one or more of the other sidewalls 132, 134, 135 may engage the coupling mechanism 108 or a different coupling mechanism.

As shown, the connector housing 122 has first and second housing shells 136, 138 that include the first and second sidewalls 132, 134, respectively. The first and second housing shells 136, 138 may be molded from, for example, a dielectric material. As shown, the first and second housing shells 136, 138 may engage each other along a seam 140 to form the sidewalls 133, 135. When coupled to each other, the first and second housing shells 136, 138 may define the housing cavity 124 therebetween. For instance, the housing cavity 124 may extend from the mating end 112 to the trailing end 114 between the first and second housing shells 136, 138. As shown, the first and second housing shells 136, 138 are not symmetrical. Instead, the first housing shell 136 constitutes a majority of the connector housing 122. However, the first and second housing shells 136, 138 may have other configurations in alternative embodiments. Yet in other embodiments, the connector housing 122 has more than two shells. Alternatively, the connector housing 122 may be a single unitary body.

The pluggable connector 106 may also include a pair of shield frames or skirts 142 that are coupled to the plug portion 123 to effectively surround the plug portion 123. The shield frames 142 include corresponding base portions 143 and spring tabs or fingers 144. The base portions 143 are secured to the plug portion 123. The spring tabs 144 extend from the corresponding base portions 143 and are configured to engage an interior surface (not shown) of the receptacle assembly 104 when the plug portion 123 of the pluggable connector 106 is inserted into the receptacle assembly 104. As shown, the spring tabs 144 may extend in a rearward direction from the corresponding base portions 143 toward the trailing end 114 and be located adjacent to the body portion 125. The spring tabs 144 may be deflected toward the plug portion 123 when the plug portion 123 is inserted into the receptacle assembly 104. The shield frames 142 may electrically ground an exterior of the plug portion 123 to reduce unwanted effects from electromagnetic interference (EMI). In other embodiments, a single shield frame may surround the entire plug portion 123.

In some embodiments, the pluggable connector 106 includes a connector retainer 146 that is coupled to the connector housing 122. The connector retainer 146 engages the first and second housing shells 136, 138 to secure the first and second housing shells 136, 138 to each other and form the connector housing 122. In the illustrated embodiment, the connector retainer 146 entirely surrounds the connector housing 122 along portions of the sidewalls 132-135. In other embodiments, the connector retainer 146 may only partially surround the connector housing 122 or only extend along a portion of one of the sidewalls 132-135. In an exemplary, the connector retainer 146 is stamped and formed from sheet metal. However, the connector retainer 146 may be manufactured in other manners.

The coupling mechanism 108 includes a latch assembly 150 and an operator-controlled actuator 152. In some embodiments, the coupling mechanism 108 may also include a portion of the connector retainer 146. For example, the connector retainer 146 may include multiple biasing fingers 154, 156. In other embodiments, the coupling mechanism 108 may include only one biasing finger. The biasing fingers 154, 156 extend toward the mating end 112 and engage the latch assembly 150. As described herein, the latch assembly 150 is configured to move between an open position and a closed position. FIG. 1 illustrates the latch assembly 150 in a closed position.

During the mating operation, when the plug portion 123 is almost entirely within the receptacle assembly 104, a housing edge 160 of the receptacle assembly 104 may engage the latch assembly 150 thereby causing the latch assembly 150 to rotate to the open position. The biasing fingers 154, 156 of the coupling mechanism 108 engage the latch assembly 150 when the latch assembly 150 is in the open position and impose a biasing force $F_1$ (FIG. 8) to urge the latch assembly 150 back toward the closed position. Accordingly, in some embodiments, the connector retainer 146 secures the first and second housing shells 136, 138 together while also providing the biasing force $F_1$ that holds the latch assembly 150 in the closed position. In alternative embodiments, the connector retainer 146 may only secure the first and second housing shells 136, 138 together or only provide the biasing force $F_1$ to the latch assembly 150.

Figure 2:
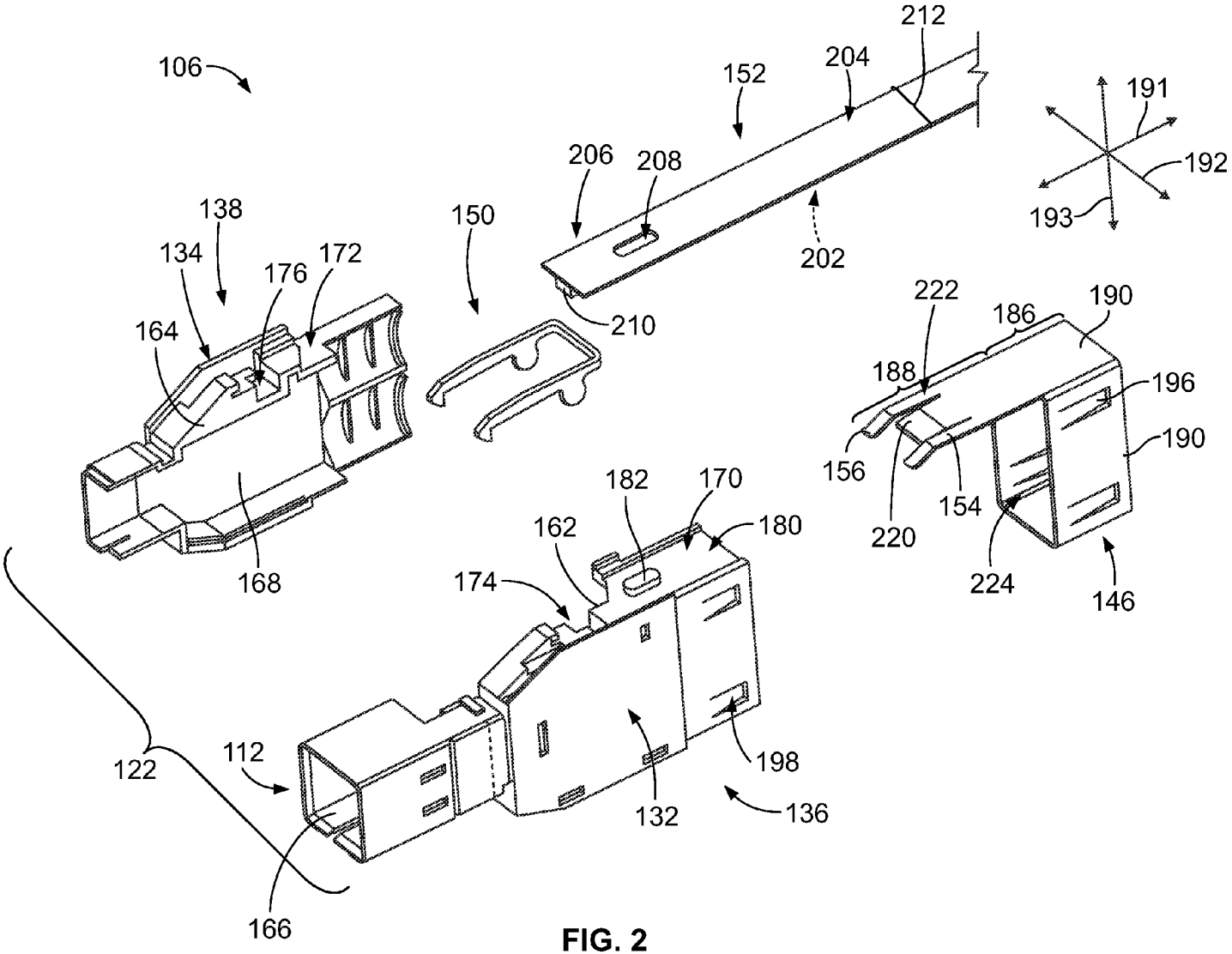
FIG. 2 is a partially exploded view of a pluggable connector formed in accordance with an embodiment that may be used with the communication system of FIG. 1.
Figure 3:
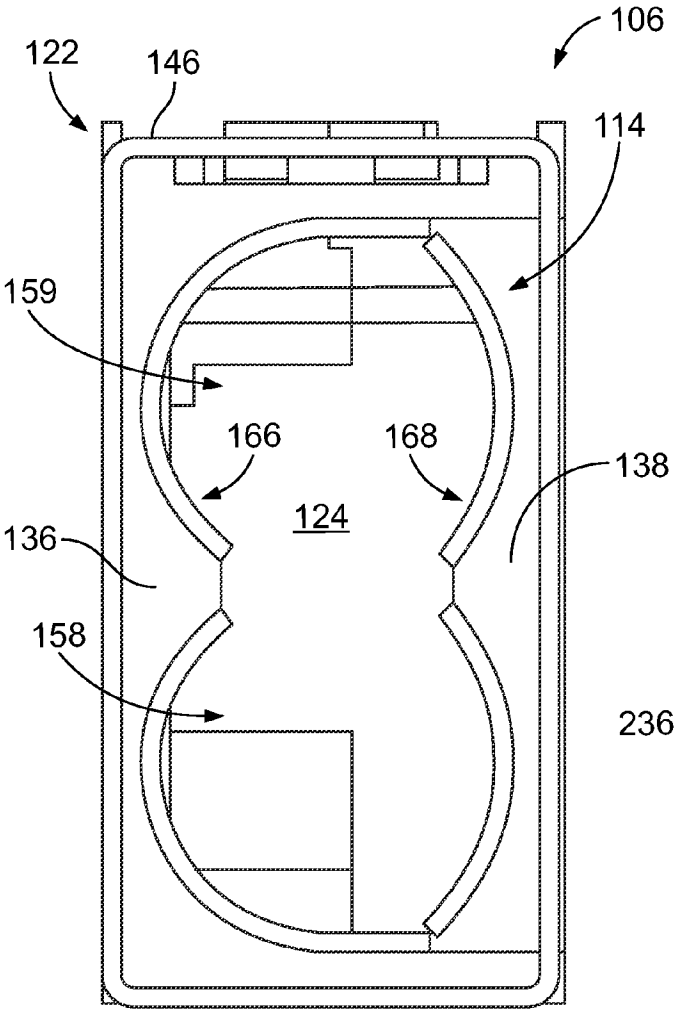
FIG. 3 is an end view of a portion of the pluggable connector that may be used with the communication system of FIG. 1.

FIG. 2 is a partially exploded view of the pluggable connector 106. In particular, FIG. 2 illustrates the first and second housing shells 136, 138, the latch assembly 150, the operator-controlled actuator 152, and the connector retainer 146. The first and second housing shells 136, 138 include edge surfaces 162, 164, respectively, that directly face each other in FIG. 2 and are configured to border each other when the first and second housing shells 136, 138 are joined. The first and second housing shells 136, 138 also have respective interior surfaces 166, 168. The interior surfaces 166, 168 define the housing cavity 124 (FIG. 1) when the first and second housing shells 136, 138 are joined together. The interior surfaces 166, 168 are also shown in FIG. 3.

The first and second housing shells 136, 138 also have respective active surfaces 170, 172. When the first and second housing shells 136, 138 are joined to form the connector housing 122, the active surfaces 170, 172 define the sidewall 133 (FIG. 1). The active surfaces 170, 172 have respective recess portions 174, 176. As described in greater detail below, the recess portions 174, 176 combine to form a latch-receiving cavity 178 (shown in FIG. 5) that receives the latch assembly 150. The active surface 170 also defines a majority of a runway 180. The runway 180 is configured to receive the operator-controlled actuator 152. Also shown, the runway 180 may include a projection 182.

As shown in FIG. 2, the operator-controlled actuator 152 is a thin strap or tether having inner and outer side surfaces 202, 204 and a connector end portion 206. The operator-controlled actuator 152 has a width 212 measured along the lateral axis 192 that is dimensioned to permit the operator-controlled actuator 152 to slide within the runway 180 along the mating axis 191. During operation, the connector end portion 206 interfaces with the connector housing 122 and engages the latch assembly 150. For example, the connector end portion 206 includes a cam element 210 that is configured to engage the latch assembly 150. The connector end portion 206 also includes an opening 208 that is sized and shaped to receive the projection 182.

The connector retainer 146 includes a retainer clip or shroud 186 and a retainer extension 188. In the illustrated embodiment, the retainer clip 186 includes a plurality of retainer walls 190 that are configured to entirely surround an exterior of the connector housing 122. The retainer walls 190 define a channel or passage 224. In alternative embodiments, the retainer clip 186 may include only one retainer wall. For example, the single retainer wall may be located within the runway 180 when the pluggable connector 106 is fully assembled. In other embodiments, the retainer clip 186 may include only two or three retainer walls 190 without entirely surrounding the connector housing 122. As shown in FIG. 2, one or more of the retainer walls 190 may include wall tabs 196. The wall tabs 196 may be inwardly biased to flex into tab recesses 198 of the connector housing 122.

The retainer clip 186 is configured to directly engage the first and second housing shells 136, 138 to secure the first and second housing shells 136, 138 to each other. The retainer extension 188 extends in a forward direction along the mating axis 191 toward the mating end 112. The retainer extension 188 includes the biasing fingers 154, 156 and a coupling tab 220. The coupling tab 220 is positioned between the biasing fingers 154, 156 and is separated from each of the biasing fingers 154, 156 by a gap or slot 222. As shown, the coupling tab 220 and the biasing fingers 154, 156 extend generally parallel to one another. For example, in the illustrated embodiment, the coupling tab 220 and the biasing fingers 154, 156 are stamped from a common sheet of material.

To assemble the pluggable connector 106, the circuit boards 126, 128 (FIG. 1) may be mechanically and electrically coupled to the communication cable 110 (FIG. 1). More specifically, the communication cable 110 and individual insulated wires (not shown) within the communication cable 110 may be stripped to expose wire conductors (not shown). The wire conductors may be terminated to the circuit boards 126, 128 in a manner that electrically couples the electrical contacts 127, 129 (FIG. 1) of the respective circuit boards 126, 128 to corresponding wire conductors. The circuit boards 126, 128 and an end portion of the communication cable 110 may then be positioned between the first and second housing shells 136, 138. The first and second housing shells 136, 138 may be combined such that the circuit boards 126, 128 and the end portion of the communication cable 110 are within the housing cavity 124 (FIG. 1).

Figure 5:
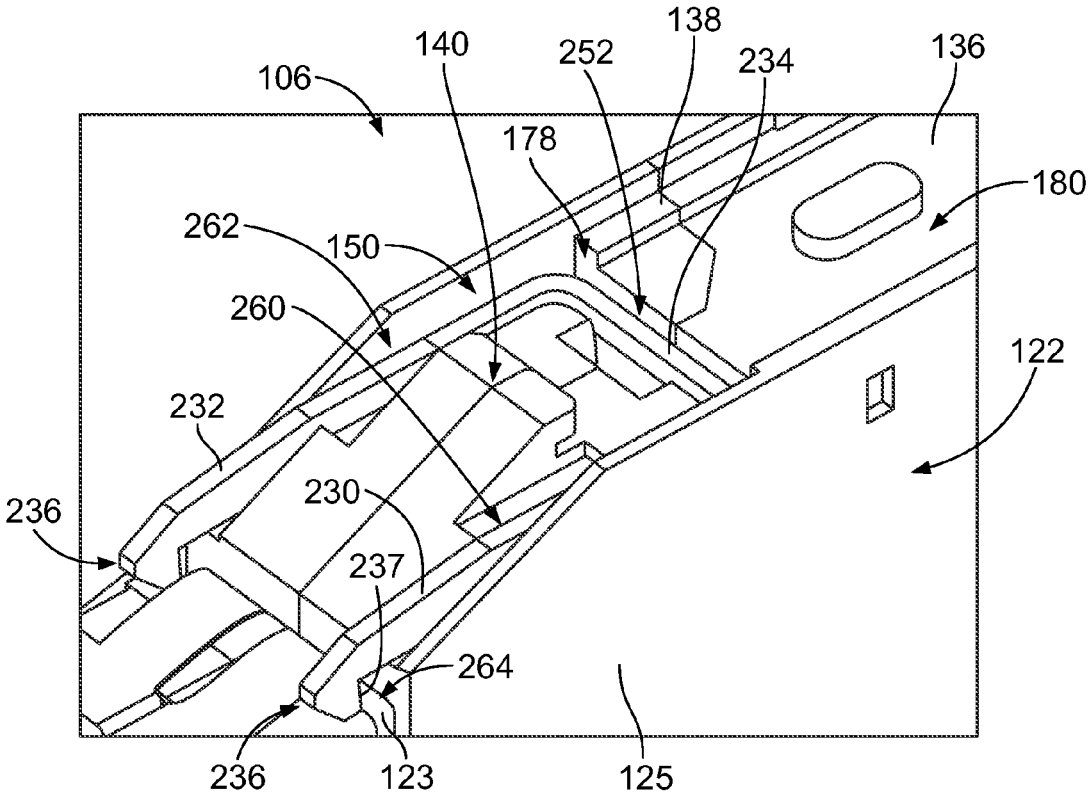
FIG. 5 is an enlarged perspective view of the pluggable connector having the latch assembly operably coupled thereto.

The latch assembly 150 may then be positioned within the recess portions 174, 176, which collectively form the latch-receiving cavity 178 (FIG. 5). The connector end portion 206 of the operator-controlled actuator 152 may be lowered along the elevation axis 193 and positioned along the connector housing 122. The operator-controlled actuator 152 may be located above the latch assembly 150 such that the latch assembly 150 is located between the connector housing 122 and the connector end portion 206. The cam element 210 may be positioned within the latch-receiving cavity 178 to engage the latch assembly 150. The runway 180 may receive the operator-controlled actuator 152, and the opening 208 may receive the projection 182.

With the operator-controlled actuator 152 extending along the runway 180, the connector retainer 146 may be moved in a forward direction along the mating axis 191 with the operator-controlled actuator 152 extending through the channel 224 of the retainer clip 186. The retainer extension 188 may slide along the outer side surface 204 of the operator-controlled actuator 152 and over the opening 208 and the projection 182 until the biasing fingers 154, 156 engage the latch assembly 150. At this time, the connector housing 122 is received within the channel 224 of the retainer clip 186. The wall tabs 196 of the connector retainer 146 may engage the sidewalls 132, 134 and be deflected outwardly by the connector housing 122 as the connector housing 122 moves through the channel 224. The wall tabs 196 may then flex into the tab recesses 198. The wall tabs 196 may prevent the connector retainer 146 from being inadvertently removed from the connector housing 122.

FIG. 3 is an end view of a portion of the pluggable connector 106. In particular, FIG. 3 illustrates the connector housing 122 and the connector retainer 146 at the trailing end 114. As shown, the first and second housing shells 136, 138 are held together by the connector retainer 146. The interior surfaces 166, 168 define the housing cavity 124 therebetween. The connector housing 122 may include cable openings 158, 159 that receive corresponding braided portions (not shown) of the communication cable 110 (FIG. 1). In an exemplary embodiment, the first and second housing shells 136, 138 are joined together without using hardware. For example, the pluggable connector 106 may be void of any elongated fasteners, such as screws or plugs, that extend laterally through the housing cavity 124 to join the first and second housing shells 136, 138. In some embodiments, the first and second housing shells 136, 138 are secured together using only the connector retainer 146 and frictional resistance between engaged surfaces of the first and second housing shells 136, 138.

Figure 4:
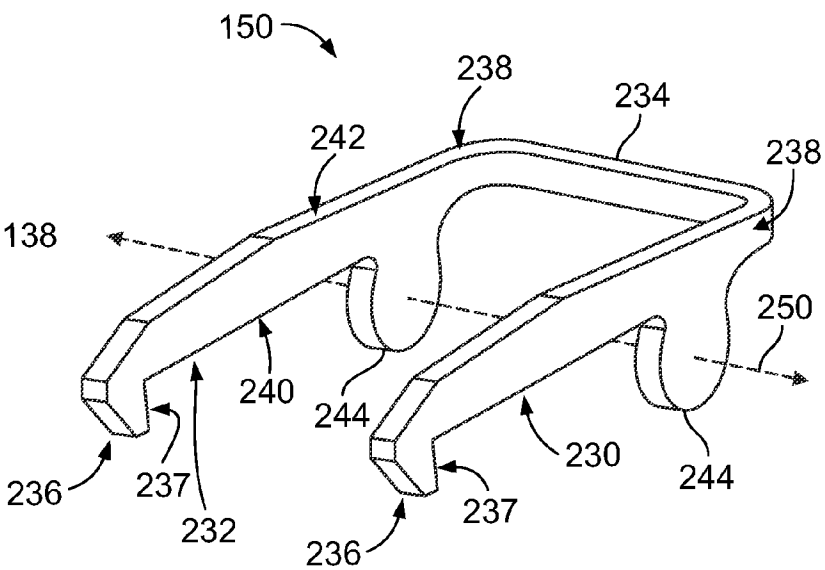
FIG. 4 is an isolated perspective view of a latch assembly that may be used with the communication system of FIG. 1.

FIG. 4 is an isolated perspective view of the latch assembly 150. The latch assembly 150 is configured to be rotated about a pivot axis 250 between a closed position (shown in FIG. 5) and an open position (shown in FIG. 9). In the illustrated embodiment, the latch assembly 150 includes multiple component latches 230, 232 and a crossbar or latch crank 234 that joins the component latches 230, 232. The latch assembly 150 is substantially U-shaped in the illustrated embodiment. In some embodiments, the latch assembly 150 is a single component that may be, for example, molded or cast from a rigid material, such as a metal or a polymer. In other embodiments, the latch assembly 150 may include only one component latch or more than two component latches. Moreover, in other embodiments, the component latches and/or the crossbar may be separate parts that are coupled together to form the latch assembly 150.

The latch assembly 150 includes an inner edge 240 and an outer edge 242. The inner edge 240 is configured to face the connector housing 122 (FIG. 1), and the outer edge 242 is configured to face away from the connector housing 122. When the pluggable connector 106 (FIG. 1) is fully constructed, the component latches 230, 232 extend generally parallel to the mating axis 191 (FIG. 1) and the crossbar 234 extends generally parallel to the lateral axis 192 (FIG. 1). Each of the component latches 230, 232 includes an operative end 236 and an opposite loading end 238. The operative end 236 is configured to engage the receptacle assembly 104 (FIG. 1). For example, the operative end 236 may be shaped to form a hook or other similar structure. The operative ends 236 include respective grip surfaces 237 that are configured to engage the receptacle assembly 104.

The crossbar 234 directly couples the loading ends 238 of the component latches 230, 232 to each other. In alternative embodiments, the crossbar 234 may extend between and join different locations of the component latches 230, 232. The crossbar 234 is configured to engage the connector end portion 206 (FIG. 2) of the operator-controlled actuator 152 (FIG. 1). In the illustrated embodiment, the crossbar 234 has a uniform cross-section as the crossbar 234 extends between the opposite loading ends 238 of the component latches 230, 232. In alternative embodiments, the crossbar 234 may have different cross-sectional dimensions that are configured relative to the connector end portion 206 such that the latch assembly 150 may be rotated as described herein.

Also shown, each of the component latches 230, 232 includes an axle projection or lug 244. The axle projections 244 extend away from the corresponding component latches 230, 232. The inner edge 240 along the axle projections 244 is shaped to engage a curved surface (not shown) of the connector housing 122 (FIG. 1). The curved surface may have a contour that is similar to the contour of the axle projections 244. In this manner, the axle projections 244 may allow the latch assembly 150 to be rotated about the pivot axis 250 between the open and closed positions. It should be noted that the configuration of the latch assembly 150 shown in FIG. 4 illustrates only one embodiment. The locations of the operative ends 236, the axle projections 244, and the crossbar 234 may be different in other embodiments.

Figure 6:
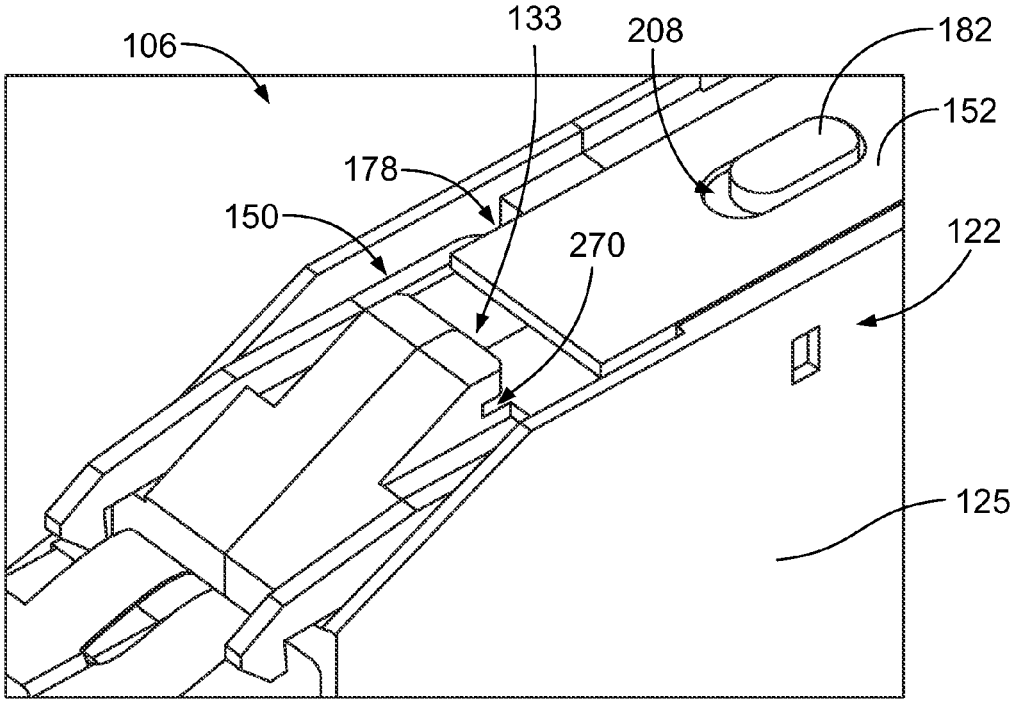
FIG. 6 is an enlarged perspective view of the pluggable connector with a coupling mechanism that includes the latch assembly.

FIGS. 5 and 6 are enlarged perspective views of the pluggable connector 106. In FIG. 5, the operator-controlled actuator 152 (FIG. 6) and the connector retainer 146 (FIG. 1) have been removed to illustrate an operable position of the latch assembly 150 with respect to the connector housing 122. FIG. 6 shows an operable position of the operator-controlled actuator 152 with respect to the latch assembly 150 and the connector housing 122.

As shown in FIG. 5, the latch assembly 150 is disposed within the latch-receiving cavity 178. The latch-receiving cavity 178 may have a shape that is similar to a shape of the latch assembly 150. For example, the latch-receiving cavity 178 is substantially U-shaped. The latch-receiving cavity 178 includes a mechanism-receiving portion 252 that is sized and shaped to receive the crossbar 234 and the cam element 210 (FIG. 2) of the operator-controlled actuator 152 (FIG. 6). The latch-receiving cavity 178 also includes latch portions 260, 262 that are sized and shaped to receive the component latches 230, 232, respectively. The mechanism-receiving portion 252 extends between and joins the latch portions 260, 262. Although not shown in FIG. 5, the axle projections 244 (FIG. 4) are received within respective cavities that have a similar shape as the axle projections 244.

Also shown in FIG. 5, the runway 180 is formed when the first and second housing shells 136, 138 are jointed along the seam 140. The runway 180 is sized and shaped to receive the operator-controlled actuator 152 (FIG. 6) and permit the operator-controlled actuator 152 to slide back and forth along the connector housing 122.

When the latch assembly 150 is operably positioned within the latch-receiving cavity 178, the operative ends 236 of the latch assembly 150 are located outside of the corresponding latch portions 260, 262. In an exemplary embodiment, the operative ends 236 may extend beyond or clear the body portion 125 of the connector housing 122 and be located adjacent to the plug portion 123. The grip surfaces 237 of the component latches 230, 232 face the body portion 125 with a receptacle space 264 therebetween.

In FIG. 6, the operator-controlled actuator 152 extends along the sidewall 133. The projection 182 of the connector housing 122 extends through the opening 208 of the operator-controlled actuator 152. The projection 182 and the opening 208 are sized and shaped relative to one another to permit the operator-controlled actuator 152 to be moved along a predetermined track within the runway 180 (FIG. 5). The operator-controlled actuator 152 may move bi-directionally along the mating axis 191 (FIG. 1). The projection 182 operates as a positive stop that limits the movable range of the operator-controlled actuator 152. Also shown in FIG. 6, the body portion 125 of the connector housing 122 includes a tab slot 270 that opens toward the trailing end 114 (FIG. 1) and is located proximate to the latch-receiving cavity 178. The tab slot 270 is sized and shaped to receive the coupling tab 220 (FIG. 2).

Figure 7:
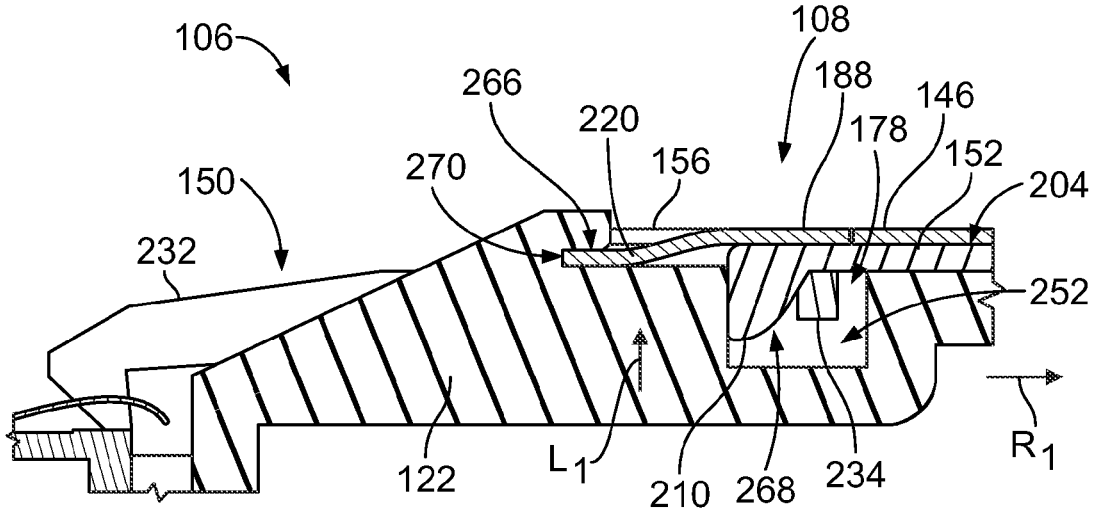
FIG. 7 is a cross-section view of a portion of the pluggable connector taken along the line 7-7 illustrating the various components of the coupling mechanism in greater detail.

FIG. 7 is a side cross-section view of a portion of the pluggable connector 106 taken along the line 7-7 in FIG. 1. The coupling mechanism 108 may include the latch assembly 150, the biasing finger 154 (FIG. 1), the biasing finger 156, and the operator-controlled actuator 152. In the illustrated embodiment, the coupling mechanism 108 utilizes each of the biasing fingers 154, 156 and each of the component latches 230, 232 (FIG. 4) of the latch assembly 150. In other embodiments, the coupling mechanism 108 may use only a single component latch and only a single biasing finger. In an exemplary embodiment, the biasing fingers 154, 156 are part of the connector retainer 146. In other embodiments, the biasing fingers 154, 156 may be separate from the connector retainer 146.

The latch assembly 150 is in the closed position in FIG. 7. As shown, the crossbar 234 and the cam element 210 are positioned within the mechanism-receiving portion 252 of the latch-receiving cavity 178. The cam element 210 has a cam surface 268 that directly engages the crossbar 234. The cam surface 268 is inclined or angled relative to the crossbar 234 such that, when the operator-controlled actuator 152 is pulled in a releasing direction $R_1$ along the mating axis 191 (FIG. 1), the cam element 210 engages the crossbar 234 thereby causing the latch assembly 150 to rotate about the pivot axis 250 (FIG. 4). With respect to FIG. 7, the latch assembly 150 is configured to rotate in a clockwise direction.

The retainer extension 188 extends along the outer side surface 204 of the operator-controlled actuator 152. An edge portion 266 of the coupling tab 220 is inserted into the tab slot 270. When the operator-controlled actuator 152 is pulled in the releasing direction $R_1$, the crossbar 234 may impose a lifting force $L_1$ that presses the operator-controlled actuator 152 against the coupling tab 220 and the retainer extension 188. The connector housing 122 engages the edge portion 266 within the tab slot 270 to prevent the coupling tab 220 and the retainer extension 188 from moving away from the connector housing 122. As such, the coupling tab 220 has a substantially fixed position relative to the connector housing 122 when the biasing finger 156 is flexed upward by movement of the component latch 232. The coupling tab 220 may facilitate maintaining the operative engagement between the cam element 210 and the crossbar 234.

Figure 8:
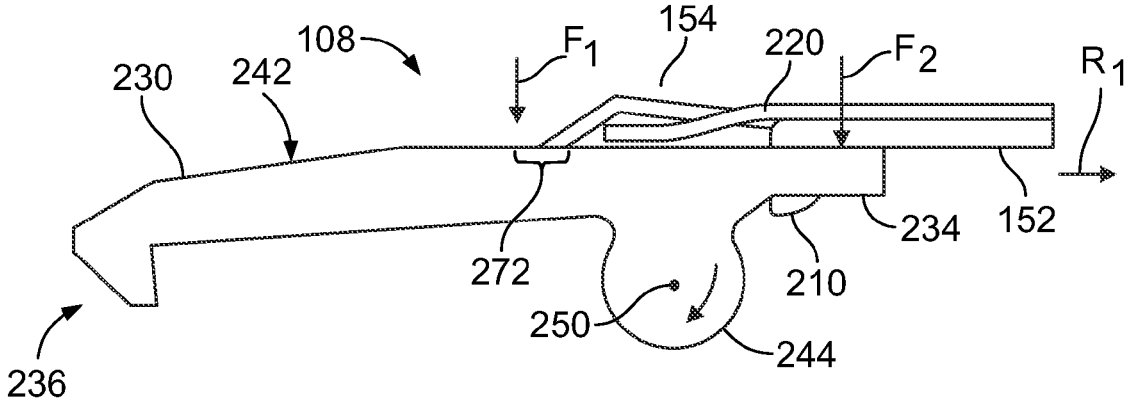
FIG. 8 is an isolated side view of the coupling mechanism when the latch assembly is in a closed position.
Figure 9:
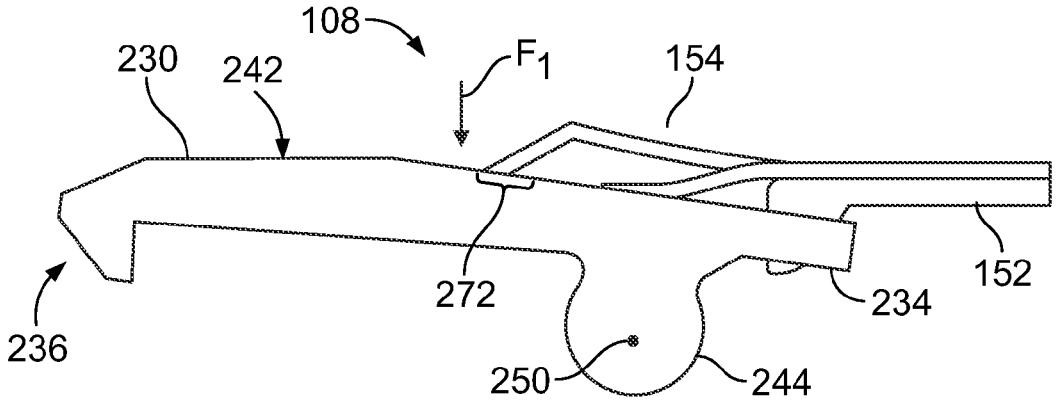
FIG. 9 is an isolated side view of the coupling mechanism when the latch assembly is in an open position.

FIGS. 8 and 9 are isolated side views of the coupling mechanism 108 when the coupling mechanism 108 is in the closed and open positions, respectively. Although the following is with specific reference to the biasing finger 154 and the component latch 230, it should be understood that the biasing finger 156 (FIG. 1) and the component latch 232 (FIG. 4) may interact in a similar manner. In the closed position, the operative end 236 may grip the receptacle assembly 104 (FIG. 1) thereby preventing the pluggable connector 106 (FIG. 1) from being inadvertently withdrawn.

The coupling mechanism 108 may impose separate forces against the component latch 230 that are in a common direction toward the pluggable connector 106 (FIG. 1) and parallel to the elevation axis 193 (FIG. 1). In some embodiments, the axle projection 244 may operate as a fulcrum and the operative end 236 and the crossbar 234 may pivot about the fulcrum. As shown in FIG. 8, the biasing finger 154 may impose the biasing force $F_1$ on one side of the axle projection 244, and the cam element 210 may impose a cam force $F_2$ on the other side of the axle projection 244. More specifically, the biasing finger 154 engages the component latch 230 at a contact area 272 along the outer edge 242. The contact area 272 is located generally between the pivot axis 250 and the operative end 236. The biasing finger 154 is configured to impose the biasing force $F_1$ at the contact area 272. In FIG. 8, the operator-controlled actuator 152 is in a home position. When the operator-controlled actuator 152 is pulled by an individual in the releasing direction $R_1$, the operator-controlled actuator 152 moves away from the home position along the mating axis 191 (FIG. 1). The cam element 210 and the coupling tab 220 cooperate to impose the cam force $F_2$ at the crossbar 234 thereby rotating the component latch 230 about the pivot axis 250. As the component latch 230 rotates about the pivot axis 250, the biasing finger 154 continues to press against the component latch 230. Thus, the biasing force $F_1$ and the cam force $F_2$ may be simultaneously experienced by the component latch 230. However, the cam force $F_2$ may overcome the biasing force $F_1$ such that the component latch 230 is rotated.

FIG. 9 shows the component latch 230 in the open position. As the component latch 230 rotates, the operative end 236 moves away from the pluggable connector 106 (FIG. 1) or the connector housing 122 (FIG. 1). The biasing finger 154 is moved or flexed by the rotating component latch 230. As such, the biasing force $F_1$ when the component latch 230 is in the open position may be greater than the biasing force $F_1$ when the component latch 230 is in the closed position. In some embodiments, the biasing finger 154 may slide along the outer edge 242 as the component latch 230 rotates away from the pluggable connector 106 or the connector housing 122.

When the component latch 230 is in the open position, the pluggable connector 106 may be freely withdrawn from the receptacle assembly 104 (FIG. 1). After withdrawing the pluggable connector 106, the individual may release the operator-controlled actuator 152 thereby reducing or removing the cam force $F_2$. At this time, the biasing finger 154 is engaged to the component latch 230 at the contact area 272 and presses the component latch 230 toward the pluggable connector 106 or the connector housing 106. The biasing force $F_1$ may be sufficient to rotate the component latch 230 back to the closed position. When the component latch 230 rotates to the closed position, the operator-controlled actuator 152 may slide forward to the home position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A pluggable connector comprising:

a connector housing having a mating end that is configured to engage a mating component during a mating operation; and a coupling mechanism attached to the connector housing, the coupling mechanism comprising a component latch and a biasing finger that engages the component latch, the component latch being rotatable about a pivot axis between open and closed positions and having an operative end that moves relative to the connector housing when the component latch is rotated about the pivot axis, wherein the biasing finger engages the component latch at a contact area that is generally between the pivot axis and the operative end when the component latch rotates from the closed position toward the open position, the biasing finger providing a biasing force at the contact area for rotating the component latch toward the closed position.

2. The pluggable connector of claim 1, wherein the component latch has an inner edge that faces the connector housing and an outer edge that faces away from the connector housing, the contact area being along the outer edge, the biasing force being toward the connector housing.

3. The pluggable connector of claim 1, further comprising a connector retainer and the connector housing having first and second housing shells, the connector retainer engaging the first and second housing shells to secure the first and second housing shells to each other, the connector retainer including the biasing finger.

4. The pluggable connector of claim 3, wherein the connector retainer includes a retainer clip that surrounds an exterior of the connector housing to secure the first and second housing shells to each other, the biasing finger being coupled to the retainer clip, wherein the retainer clip has a substantially fixed position relative to the connector housing.

5. The pluggable connector of claim 1, further comprising a connector retainer coupled to the connector housing and having a retainer extension that extends toward the mating end, the retainer extension including the biasing finger and a coupling tab, the biasing finger and the coupling tab extending generally parallel to each other and being separated by a gap, the coupling tab being coupled to the connector housing such that the coupling tab has a substantially fixed position relative to the connector housing when the biasing finger moves to the open position.

6. The pluggable connector of claim 1, wherein the coupling mechanism further comprises an operator-controlled actuator that engages the component latch and rotates the component latch to the open position when activated by an operator.

7. The pluggable connector of claim 6, wherein the connector housing includes a latch-receiving cavity that is sized and shaped to receive a portion of the component latch and a portion of the operator-controlled actuator.

8. The pluggable connector of claim 1, wherein the component latch is a first component latch and the coupling mechanism further comprises a second component latch and a crossbar that extends between and joins the first and second component latches, the first and second component latches having elongated bodies that extend parallel to each other, wherein the coupling mechanism further comprises an operator-controlled actuator that engages the crossbar and rotates the component latch to the open position when activated by an operator.

9. The pluggable connector of claim 1, wherein biasing finger flexes away from the connector housing as the component latch is rotated to the open position.

10. The pluggable connector of claim 1, wherein the component latch includes an outer edge that has the contact area, the biasing finger sliding along the outer edge as the component latch is rotated to the open position.

11. The pluggable connector of claim 1, wherein each of the biasing finger and the component latch have elongated bodies that extend parallel to a mating axis of the pluggable connector.

12. The pluggable connector of claim 1, wherein the component latch is a first component latch and the biasing finger is a first biasing finger, the coupling mechanism further comprising a second component latch that extends parallel to and spaced apart from the first component latch, the coupling mechanism further comprising a second biasing finger that extends parallel to and spaced apart from the first biasing finger, wherein the second biasing finger engages the second component latch at a corresponding contact area, the second biasing finger providing a biasing force at the corresponding contact area for rotating the second component latch toward the closed position.

13. A pluggable connector comprising:

a connector housing having a mating end that is configured to engage a communication component during a mating operation, the connector housing having first and second housing shells;

a connector retainer including a retainer clip that secures the first and second housing shells to each other, the connector retainer including a retainer extension that extends from the retainer clip toward the mating end, the retainer extension comprising a biasing finger; and a component latch coupled to the connector housing and having an operative end configured to engage the communication component, wherein the component latch rotates from a closed position to an open position during the mating operation, the biasing finger engaging the component latch when the component latch is in the open position to provide a biasing force for rotating the component latch toward the closed position.

14. The pluggable connector of claim 13, wherein the component latch has an inner edge that faces the connector housing and an outer edge that faces away from the connector housing, the biasing finger engaging the outer edge.

15. The pluggable connector of claim 13, wherein the retainer clip surrounds an exterior of the connector housing to secure the first and second housing shells to each other, the retainer clip having a substantially fixed position relative to the connector housing.

16. The pluggable connector of claim 13, further comprising at least one circuit board that is positioned between the first and second housing shells and that has electrical contacts disposed at the mating end.

17. The pluggable connector of claim 13, wherein the retainer extension includes a coupling tab, the biasing finger and the coupling tab extending generally parallel to each other and being separated by a gap, the coupling tab being coupled to the connector housing such that the coupling tab has a substantially fixed position relative to the connector housing when the biasing finger moves to the open position.

18. A pluggable connector comprising:

a connector housing having a mating end that is configured to engage a communication component during a mating operation, the connector housing having first and second housing shells;

a connector retainer including a retainer clip that secures the first and second housing shells to each other, the connector retainer including a retainer extension that extends from the retainer clip toward the mating end, the retainer extension comprising a biasing finger; and a component latch coupled to the connector housing and having an operative end configured to engage the communication component, wherein the component latch rotates from a closed position to an open position during the mating operation, the biasing finger engaging the component latch when the component latch is in the open position to provide a biasing force for rotating the component latch toward the closed position;

an operator-controlled actuator that engages the component latch and rotates the component latch to the open position when activated by an operator;

wherein the operator-controlled actuator is disposed between the retainer extension and the connector housing to engage the component latch.

19. The pluggable connector of claim 18, wherein the connector housing includes a latch-receiving space that is sized and shaped to receive a portion of the component latch and a portion of the operator-controlled actuator.

20. The pluggable connector of claim 18, wherein the component latch is a first component latch and the pluggable connector further comprises a second component latch and a crossbar that extends between and joins the first and second component latches, the operator-controlled actuator engaging the crossbar when activated.

* * * * *